United States Patent [19]

Hozuma et al.

[11] 4,243,633

[45] Jan. 6, 1981

[54] REACTOR FOR THE THERMAL CRACKING OF HEAVY OIL

[75] Inventors: Hiroshi Hozuma; Hisatoshi Ohwada; Masaharu Tomizawa; Seiki Sanada; Hideo Kikuchi, all of Iwaki, Japan

[73] Assignees: Kureha Kagaku Kogyo Kabushiki Kaisha, Tokyo; Chiyooa Chemical Engineering and Construction Co., Ltd., Kanagawa, both of Japan

[21] Appl. No.: 845,303

[22] Filed: Oct. 25, 1977

Related U.S. Application Data

[63] Continuation-in-part of Ser. No. 733,911, Oct. 19, 1976, abandoned.

[30] Foreign Application Priority Data

Oct. 22, 1975 [JP] Japan ..... 50-126276

[51] Int. Cl.[3] ..... C10G 9/04; C10G 9/12

[52] U.S. Cl. ..... 422/129; 134/167 R; 196/122; 196/126; 196/127; 196/128; 202/241; 208/48 Q; 422/226

[58] Field of Search ..... 23/283, 285, 281; 196/122, 126, 127, 128; 202/241; 134/167 R, 168 R, 180, 181; 208/48; 261/88; 422/129, 226, 207

[56] References Cited

U.S. PATENT DOCUMENTS

| | | | |
|---|---|---|---|
| 1,783,257 | 12/1930 | Morrel et al. | 196/107 X |
| 1,912,629 | 6/1933 | Fisher | 208/48 R |
| 2,326,525 | 8/1943 | Diwoky | 208/48 |
| 2,345,603 | 4/1944 | Houdry et al. | 196/122 |
| 2,802,725 | 8/1957 | Kappel | 23/281 |
| 3,522,016 | 7/1970 | Groves et al. | 23/277 R |
| 3,836,434 | 9/1974 | Novy | 201/2 |
| 3,880,359 | 4/1975 | Novy | 202/241 X |
| 3,953,226 | 4/1976 | Emond et al. | 134/168 R |
| 3,985,572 | 10/1976 | Petermann et al. | 134/22 R X |

*Primary Examiner*—Michael S. Marcus

*Attorney, Agent, or Firm*—Stevens, Davis, Miller & Mosher

[57] ABSTRACT

A closed reactor for the thermal cracking of heavy oils, having an internally mounted, rotatable injection pipe. The injection pipe is adapted to spurt preheated raw material under pressure against the inner wall surfaces of the reactor while rotating to remove coke which has deposited on the reactor walls during the previous cracking operation.

3 Claims, 2 Drawing Figures

REACTOR FOR THE THERMAL CRACKING OF HEAVY OIL

CROSS-REFERENCE TO RELATED APPLICATION

The present application is a continuation-in-part of application Ser. No. 733,911, filed Oct. 19, 1976, and entitled "A METHOD AND APPARATUS FOR DECOKING REACTORS FOR THERMAL CRACKING OF HEAVY OILS", now abandoned.

FIELD OF THE INVENTION

This invention provides a reactor of an improved design for the thermal cracking of heavy oils.

BACKGROUND OF THE INVENTION

When heavy hydrocarbons such as asphalt, coal tar, heavy oils and crude petroleum are thermally cracked in a reactor, coke is formed as deposits on the inner wall surfaces of the reactor. Accordingly, in order to operate the reactor efficiently on an industrial scale, it is necessary to adequately remove the coke from the inner wall surfaces of the reactor.

In the prior art method of removing coke from the inner wall surfaces of the reactor, the operation of the reactor is suspended and, after cooling the reactor, the coke is mechanically removed by a conventional cleaning method using, for example, a waterjet. Such a method, however, has the disadvantage that continuous operation of the reactor is not possible due to the need to temporarily suspend the operation of the reactor.

SUMMARY OF THE INVENTION

Therefore, it is an object of the present invention to provide a reactor for the thermal cracking of heavy oils, in which coke may be effectively removed during operation, without shutdown of the operation.

This and other objects of the present invention will become clear from the following description.

According to the present invention, there is provided a reactor for the thermal cracking of a heavy oil having a rotatable injection pipe mounted through a top opening. The injection pipe may be contoured similar to the interior wall surface so as to extend along that surface at a constant spaced distance. The injection pipe is provided with a plurality of jets along its length. The reactor is further provided with means for rotating the injection pipe therein; a first conduit for feeding an inert fluid to the injection pipe; a second conduit for feeding preheated raw material at 300°-350° C. to the injection pipe; and switching means for connecting the injection pipe to the first conduit during thermal cracking and to the second conduit for decoking subsequent to each thermal cracking batch operation.

DETAILED DESCRIPTION OF THE INVENTION

Figure 1:
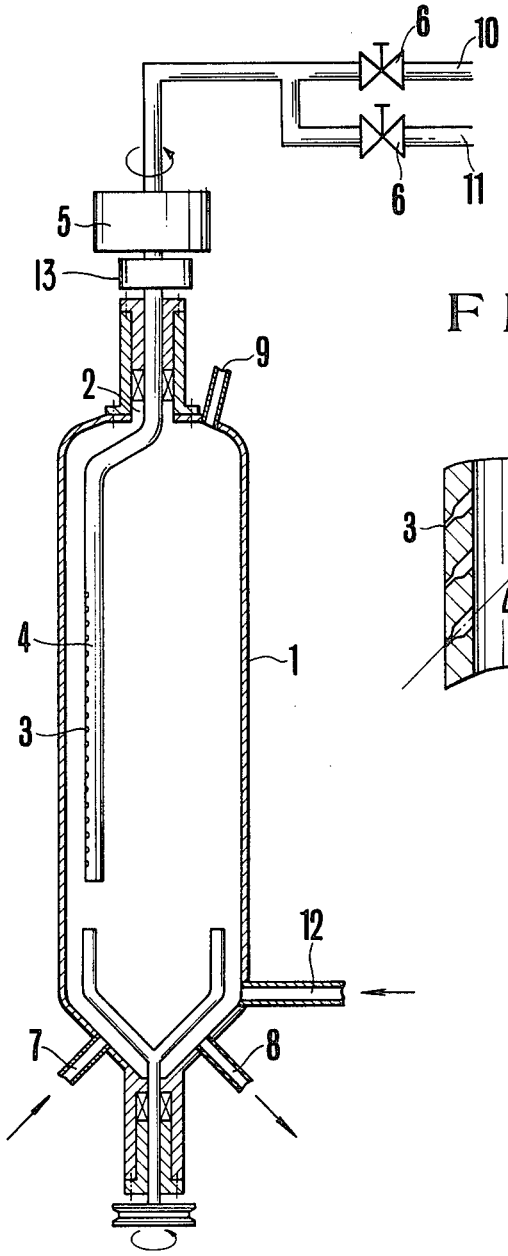
FIG. 1 is a diagrammatic view of a heavy oil cracking reactor according to the present invention, which is provided with a rotary injection pipe.

Referring to FIG. 1, there is shown a reaction column (reactor) 1 for the thermal cracking of heavy oil. The construction of the shell of the reaction column 1 itself is conventional and, therefore, will not be discussed in detail. The reaction column 1 is provided with a rotary decoking injector, which has an injection pipe 4 extending into the reaction column 1 through an opening 2 at its top. The injection pipe 4 mounted within the reaction column 1 may be contoured to extend along the inner wall surfaces of the reaction column 1 at a relatively constant spaced distance. The injection pipe 4 includes two vertically offset portions and a curved shoulder portion, and has a multitude of jets 3 formed through its wall and which open toward the interior wall surface of the reaction column 1. The injection pipe 4 is slowly rotated about the axis of the column 1 at a spaced distance from the inner wall surfaces of the column 1 by a suitable drive means 5, for example, an electric motor which is mounted above the column 1 and has a drive shaft connected to the pipe 4 through a reducer. The upper end of the injection pipe 4 is connected to conduits 10 and 11 through a switching means 6 such as an electromagnetic valve or the like. In FIG. 1, the switching means 6 is in the form of dual valves which are interlocked so that when one valve opens the other valve shuts.

Figure 2:
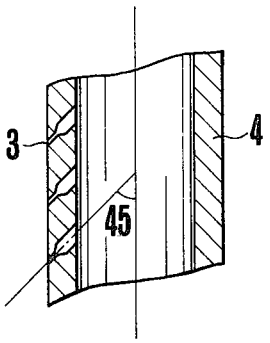
FIG. 2 is a fragmentary sectional view on an enlarged scale of a rotary injection pipe having jets formed in its wall.

For thermally cracking a heavy oil using the reactor of the present invention, the raw material is introduced into the reactor through inlet 12 and superheated steam at a temperature of 400°-2000° C. is introduced into the reactor through inlet 7. During the thermal cracking of the heavy oil, a fluid which is inert to the thermal cracking reaction, for example, nitrogen gas or steam, is fed to the injection pipe 4 through the conduit 10 and injected through the jets 3 to prevent the jets 3 from being clogged by the reactor contents. Port 9 provides an outlet for the inert gas and the gaseous products of the cracking operation. Until termination of the thermal cracking, the injection pipe 4 may be held motionless without rotation. When the thermal cracking is completed and the reaction product is withdrawn from the reaction column 1 via outlet 8, the injection pipe 4 is connected to the conduit 11 by the switching means 6 for receipt, under pressure, of a portion of the heavy oil to be charged for thermal cracking in the subsequent batch operation. The injection pipe 4 sprays or spurts the received raw material through the jets 3 while rotating within the column 1, to remove the coke which has deposited on the inner wall surfaces of the column 1 during the previous cracking operation. Each of the jets 3 formed through the wall of the injection pipe 4 opens toward the inner wall surface of the column 1 at the angle of 25-90 degrees, preferably 45-75 degrees, with respect to the center axis of the injection pipe 4. If the angle is less than 25 degrees or larger than 90 degrees, effective removal of the coke is not achieved. Therefore, an angle within the specified range is necessary. While the configuration of the jet 3 may vary, it is preferable that the jets 3 be in the form of holes passing through the wall of the injection pipe 4. On the other hand, if the jet is of a construction whereby it projects from the outer surface of the injection pipe 4, coke will deposit on the outer surface of the projecting portion in an amount sufficient to hinder rotation of the injection pipe 4. FIG. 2 shows a preferred orientation and construction of the jets 3 in the wall of the pipe 4. The number of the jets 3 is determined by a number of factors including the pressure, amount and time of the injection, and the jet diameter.

As clear from the above, one of the features of the invention resides in the injection of a given portion of the raw material heavy oil batch charge, for the thermal cracking is fed to and injected through the injection pipe 4 as a scrubbing liquid, for the purpose of removing coke deposited during the previous batch operation.

When the decoking operation is finished, the remainder of the raw material heavy oil is admitted in the usual manner via inlet 12 into the reaction column 1 in which the injected heavy oil has collected at the bottom together with the removed coke. Therefore, there is no need for providing additional equipment for the treatment of the spent scrubbing liquid and the operation is simplified to a significant degree.

It has been confirmed that the coke which is allowed to collect at the bottom of the reaction column 1 occupies as little as less than 0.1 wt percent so that it has almost no adverse affect on the quality of the pitch end product.

For the sake of heat balance, it is preferred that the injected heavy oil be preheated to a temperature in the range of 300°–350° C. A preheating temperature above 350° C. is not preferred as it would invite coking of the injection pipe itself.

To make the decoking more effective, the injection pipe 4 may be slowly moved up and down, while rotating along the inner wall surface of the reaction column 1, by employing any conventional means 13 capable of mechanically reciprocating the pipe 4 axially.

The higher the pressure for the injection of a portion of the raw material (heavy oil) from the jets 3, the higher the coke-removing efficiency; however, as a practical matter, it operates effectively at a pressure of at least 5 kg/cm$^2$ G. The preferred pressure is between 15 and 30 kg/cm$^2$ G.

When the rotation of the pipe 4 is too rapid, the coke-removing efficiency is lowered. Accordingly, the peripheral velocity of the movement of the pipe 4 should be less than 500 mm/sec, preferably in the range of 10–100 mm/sec.

A single injection pipe 4 is provided in the embodiment shown in FIG. 1, however, a plurality of such injection pipes may be located at suitable intervals along the inner periphery of the reaction column, particularly where the reactor is of a large diameter. The shape and the number of the injection pipes are therefore to be determined to conform with the shape and size of the reaction column.

The present invention can greatly contribute to the rationalization of the operations involved in the production of a binder pitch by the thermal cracking of heavy oil, in which decoking has been one of the serious problems. The elimination of the decoking problem has great industrial significane in view of the increasing demand for binder pitch due to lack of coking coal for the production of blast furnace coke. The by-product oils can be easily desulfurized by a conventional desulfurizing process to provide fuel oils of diversified types.

EXAMPLE 1

After preheating to 490° C., a vacuum residue of Khafji crude oil was charged at a rate of 300 kg/hr for 2 hours into a reactor which had an inner diameter of 600 mm and a height of 5000 mm. For protection against thermal shock, the reactor was precharged with 60 kg of same oil residue which had been heated to 300° C. Steam at 700° C. was blown into the bottom of the reactor through the bottom thereof at a rate of 120 kg/hr for thermal cracking while removing the cracked gases through the exhaust pipe at the top of the reactor. The temperature of the charged raw material in the reactor was maintained at 425° C. The thermal cracking was allowed to proceed for 2 hours after the completion of the charging operation. The product (pitch) was cooled instantly and entirely withdrawn from the reactor. The same cycle of operation was repeated starting with the precharging of 60 kg of preheated raw material for protection against thermal shock.

The above thermal cracking operation was repeated for 200 hours during which coke deposited on the inner wall surfaces of the reactor to a thickness of 81 mm, thus hindering normal cracking operation.

The same semibatchwise cracking operation was carried out using a reactor, which had an inner diameter of 600 mm and a height of 5000 mm and which was provided with a rotary injection pipe as shown in FIG. 1. The injection pipe had 18 jets 2.5 mm in diameter formed in its wall at angles of 45° as shown in FIG. 2. During the cracking operation, steam at 350° C. was blown through the jets of the injection pipe at a rate of 60 kg/hr to prevent their clogging. As soon as the thermal cracking was completed, the molten pitch product was cooled. After the pitch was withdrawn from the bottom of the reactor, the injection pipe was rotated at a speed of 4 rpm and preheated raw material at 300° C. was injected for 15 seconds under a pressure of 18 kg/cm$^2$ G (as measured upstream of the jets) to remove the deposited coke from the reactor wall surfaces. The raw material used for the removing operation was left in the reactor to serve as a precharge for protection against thermal shock.

The above thermal cracking operation was repeated for 200 hours during which coke only deposited on the reactor wall to a thickness less than 5 mm, thus confirming the decoking effect of the present invention.

EXAMPLE 2

After preheating to 490° C., a vacuum residue of Khafji crude oil was charged at a rate of 50 tons/hr for 2 hours into a reactor having an inner diameter of 5500 mm and a height of 14300 mm and provided with a rotary injection pipe as shown in FIG. 1. For protection against thermal shock, the reactor was precharged with 10 tons of the same oil residue which had been heated to 340° C. Superheated steam at 700° C. was blown into the bottom of the reactor at a rate of 16 tons/hr for thermal cracking while the cracked gases were removed through the exhaust pipe at the top of the reactor. The thermal cracking was allowed to proceed for 2 hours after the completion of the charging operation. The injecton pipe had 50 jets of 3 mm in diameter formed in its wall at angles of 45° as shown in FIG. 2.

During the cracking operation, steam at 350° C. was injected through the jets of the injection pipe at a rate of 500 kg/hr to prevent jet clogging. As soon as the thermal cracking was completed, the molten pitch so produced was cooled. After the pitch was withdrawn through the bottom of the reactor, the injection pipe was rotated at a speed of 0.1 rpm (29 mm/sec.) and preheated raw material at 340° C. for 10 minutes in an amount of 10 tons, under a pressure of 18 kg/cm$^2$ G, to remove the deposited coke from the reactor wall surfaces. The distance between the inner wall surface of the reactor and the injection pipe was 300 mm. The raw material used for the coke removal operation was left in the system to serve as a precharge for protection against thermal shock.

The above thermal cracking operation was repeated for 2700 hours during which time coke deposited on the reactor wall only in a thickness of 50–150 mm.

What is claimed is:

1. In a reactor for the thermal cracking of a heavy oil raw material comprising means defining a cracking reactor and an injection pipe, the improvement comprising:

said injection pipe being inserted into said reactor through a top opening in said reactor, said injection pipe having two vertically extended portions offset from one another, one of said portions being located on the axis of said reactor and the other of said portions extending along an interior wall surface of said reactor at a closely spaced distance from said wall surface, said injection pipe being provided with a multitude of spouting jets longitudinally spaced along its length, each of said spouting jets being formed in the wall of said injection pipe at an angle of 25° to 90° with respect to the longitudinal axis of the injection pipe;

means for rotating said injection pipe within said reactor;

a first conduit for feeding an inert fluid to said injection pipe;

a second conduit for feeding the preheated raw material at a temperature of 300° to 350° C. to said injection pipe;

switching means for connecting said injection pipe to said first conduit during thermal cracking and to said second conduit for decoking subsequent to the thermal cracking; and means for reciprocating movement of the injection pipe axially therein.

2. The reactor of claim 1 wherein said switching means is an electromagnetic valve.

3. The apparatus of claim 1 wherein said angle is 45°–75°.

* * * * *

UNITED STATES PATENT AND TRADEMARK OFFICE

CERTIFICATE OF CORRECTION

PATENT NO. : 4,243,633

DATED : January 6, 1981

INVENTOR(S) : Hiroshi HOZUMA ET AL

It is certified that error appears in the above—identified patent and that said Letters Patent is hereby corrected as shown below:

On The Title Page:

In the name of the Assignees, please change "Chiyooa" to read --Chiyoda--

Signed and Sealed this

*Ninth* Day of *June 1981*

[SEAL]

*Attest:*

RENE D. TEGTMEYER

*Attesting Officer*

*Acting Commissioner of Patents and Trademarks*